US006932750B1

(12) United States Patent
Dorner

(10) Patent No.: US 6,932,750 B1
(45) Date of Patent: Aug. 23, 2005

(54) EXERCISE STAND

(76) Inventor: Michael W. Dorner, 1107 Beach View Cir., Camarillo, CA (US) 93012

( * ) Notice: Subject to any disclaimer, the term of this patent is extended or adjusted under 35 U.S.C. 154(b) by 0 days.

(21) Appl. No.: 10/198,352

(22) Filed: Jul. 17, 2002

Related U.S. Application Data

(60) Provisional application No. 60/307,135, filed on Jul. 24, 2001.

(51) Int. Cl.[7] ..... A63B 26/00

(52) U.S. Cl. ..... 482/142; 482/141; 482/62; 482/907; 482/148; 482/23; 482/70

(58) Field of Search ..... 482/142, 148, 482/907, 62, 141, 70, 23; 5/507.1, 600; 473/4; D24/183; 108/144.11; 223/120; 433/25; 248/676, 163.1; 602/60, 66

(56) References Cited

U.S. PATENT DOCUMENTS

| | | | | |
|---|---|---|---|---|
| 2,666,640 A | | 1/1954 | Jennings, Sr. | |
| 4,111,417 A | * | 9/1978 | Gardner | 482/128 |
| D265,575 S | | 7/1982 | Lunford | |
| 4,406,373 A | * | 9/1983 | Braden | 209/574 |
| 4,506,884 A | * | 3/1985 | Hankin | 482/131 |
| 4,619,454 A | * | 10/1986 | Walton | 482/128 |
| 4,666,154 A | | 5/1987 | Lipscomb et al. | |
| 4,923,194 A | * | 5/1990 | Montgomery | 272/93 |
| 5,074,549 A | * | 12/1991 | Harvey | 482/148 |
| 5,147,266 A | * | 9/1992 | Ricard | 482/131 |
| 5,205,802 A | | 4/1993 | Swisher | |
| 5,209,711 A | * | 5/1993 | Scrima | 482/70 |
| 5,290,209 A | | 3/1994 | Wilkinson | |
| 5,295,935 A | | 3/1994 | Wang | |
| 5,480,367 A | | 1/1996 | Bergman | |
| 5,518,484 A | * | 5/1996 | Bruckenstein | 482/131 |
| 5,527,242 A | | 6/1996 | Gangloff | |
| 5,662,556 A | | 9/1997 | Gangloff | |
| 6,129,651 A | | 10/2000 | Denaro | |
| 6,248,048 B1 | | 6/2001 | Zuckerman et al. | |
| 6,428,496 B1 | * | 8/2002 | Sargent | 602/32 |

FOREIGN PATENT DOCUMENTS

| | | | | |
|---|---|---|---|---|
| GB | 2274999 A | * | 8/1994 | A63B 23/04 |

* cited by examiner

*Primary Examiner*—Lori Amerson
(74) *Attorney, Agent, or Firm*—Jack C. Munro

(57) ABSTRACT

An exercise stand which is constructed of a main frame on which are mounted a leg at each corner. The leg is to support the main frame in a spaced position above a supporting surface. A pair of sub-frames are mounted on the main frame with each sub-frame being lineally slidably movable in a direction on the main frame to vary spacing between the sub-frames. Each sub-frame includes a plurality of members with each member on the sub-frame having a different orientation. A human user is capable of performing a plurality of different exercises using these members.

3 Claims, 2 Drawing Sheets

EXERCISE STAND

This application is to reference U.S. Provisional patent application Ser. No. 60/307,135, filed Jul. 24, 2001, entitled PUSH-N-PULL BODY-CISER by the present inventor, Michael Wayne Dorner.

BACKGROUND OF THE INVENTION

1. Field of the Invention

The field of this invention relates to an exercise apparatus and more particularly to an exercise stand which is designed to be used in conjunction with a supporting surface.

2. Description of the Related Art

There is a significant trend within all of society for humans to pursue physical fitness. There have been a tremendous number of pieces of equipment that have been designed and are utilized in conjunction with this physical fitness trend. It has been noticed by the present inventor that exercise machines exist which enable a user to perform equal and opposite exercises (e.g., leg extensions and leg curls) in order to develop their legs in a balanced and symmetric way. However, common exercises, such as pull-ups and seated rows are not equal and opposite to the pressing movements (e.g., bench press or push-ups) used to develop the chest muscles. Therefore, the chest and back muscles are not worked and developed in symmetric balance. Developing and keeping the body in symmetric balance is important for achieving and maintaining proper posture and body mechanics, promotes improved athletic performance, and reduces the occurrence and/or severity of sports injuries.

Furthermore, the present inventor has noticed that, due to limited strength and/or physical discomfort, many people cannot sufficiently perform traditional push-ups, seated rows, or pull-ups. Push-ups, which work the triceps, anterior deltoid, and pectoral muscles, are usually performed by placing one's toes and hands on a horizontal supporting surface with the body being in a straight, stiff position. By exertion of the arms to push the body away from the ground by full extension of the arms and a return toward the ground by bending of the arms, a push-up is accomplished. Performing push-ups with palms flat against the floor often cases wrist pain and, therefore, this exercise is often avoided or discontinued before optimal benefits can be achieved. A pull-up works the posterior (rear) deltoids and the latissimus dorsi muscles of the back and is accomplished by hanging vertically from a horizontal bar sufficiently high enough above the ground that when the bar is held by the hands the body of the individual is suspended in air. By pulling of one's body to a height, usually so the head of the person extends above the horizontal bar and return of the body to a relaxed hanging position, a pull-up is accomplished. Many people lack the strength necessary to perform even a single traditional pull-up. Therefore, this exercise is often avoided. Finally, seated rows, which also work the posterior (rear) deltoids and the latissimus dorsi muscles of the back, are done by reaching forward and pulling a handle toward one's waist against a desired amount of resistance while sitting upright with feet resting on a supporting surface in front of the body. This exercise places a substantial load on the spine and lower back muscles, which can lead to discomfort or even injury.

Insufficient strength, discomfort and/or injuries often prevent or discourage people from performing traditional pull-ups, push-ups, and/or seated rows. If an apparatus was developed that would enable people of various strength levels to safely and comfortably work their upper body in perfect symmetric balance, it could be used by a wide range of individuals.

SUMMARY OF THE INVENTION

The basic embodiment of this invention is an exercise stand which is formed of a main frame. A plurality of legs is mounted to the main frame with each leg extending outward from the main frame and is adapted to rest on a supporting surface. The main frame is spaced from the supporting surface forming an underneath area located between the main frame and the supporting surface and an over area located above the main frame. The over area is designed to be used in conjunction with push-ups and the underneath area is designed to be used in conjunction with "reverse push-ups" which can also be defined as pull-ups. A pair of sub-frames are mounted on the main frame. Each sub-frame is lineally slidably movable in a direction on the main frame to vary the spacing between the sub-frames. Each sub-frame includes a plurality of grabable exercise members with each member on the sub-frame having a different orientation. A human user can perform a plurality of different exercises using these members.

A further embodiment of the present invention is where the basic embodiment is modified by having the main frame constructed of a plurality of interconnected elongated members.

A further embodiment of the present invention is where the plurality of interconnected elongated members are located in a rectangular configuration.

A further embodiment of the present invention is where the just previous embodiment is modified by each sub-frame being constructed of a pair of main support members which are parallel and have a longitudinal axis which is parallel to the direction of movement of the sub-frame on the main frame.

A further embodiment of the present invention is where the just previous embodiment is modified by two members being located transverse to the main support members with these two members being defined as cross members.

A further embodiment of the present invention is where the just previous embodiment is modified by the cross members forming a right angle with one of the main support cross members.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF THE INVENTION

Figure 1:
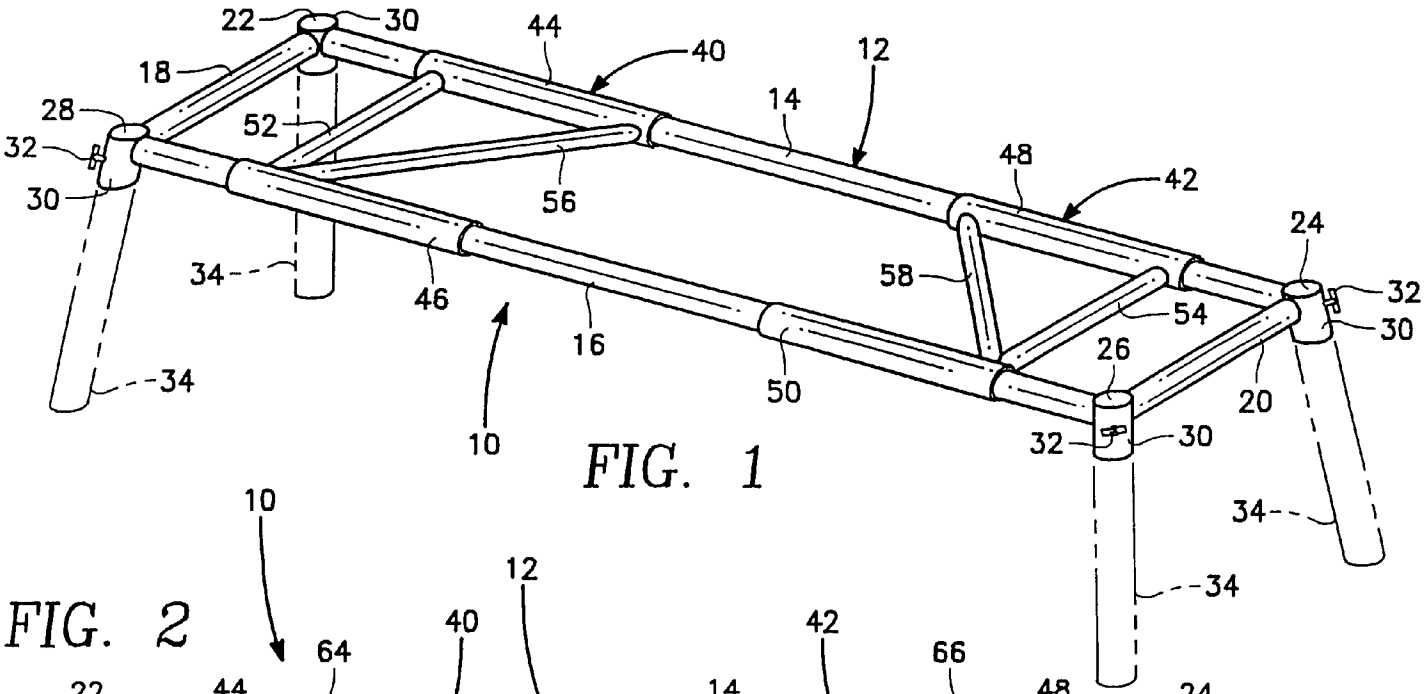
FIG. 1 is an isometric view of the exercise stand of the present invention.
Figure 2:
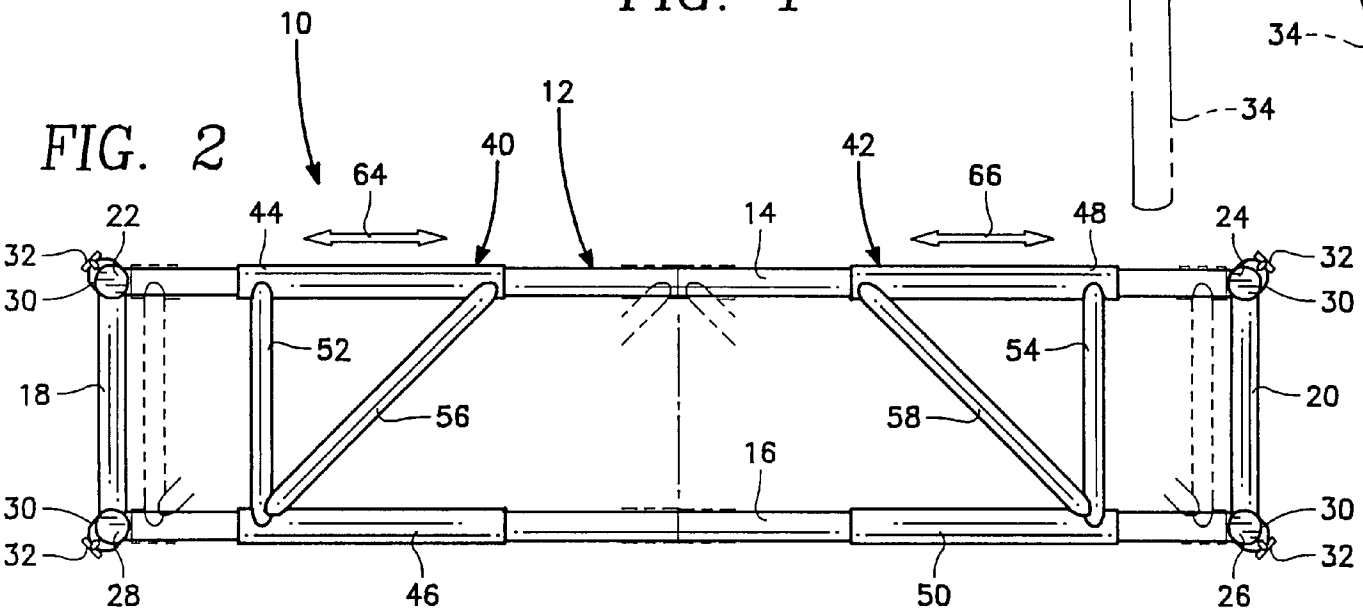
FIG. 2 is a top plan view of the exercise stand of the present invention depicting the movement of the sub-frames on the main frame of the exercise stand.
Figure 3:
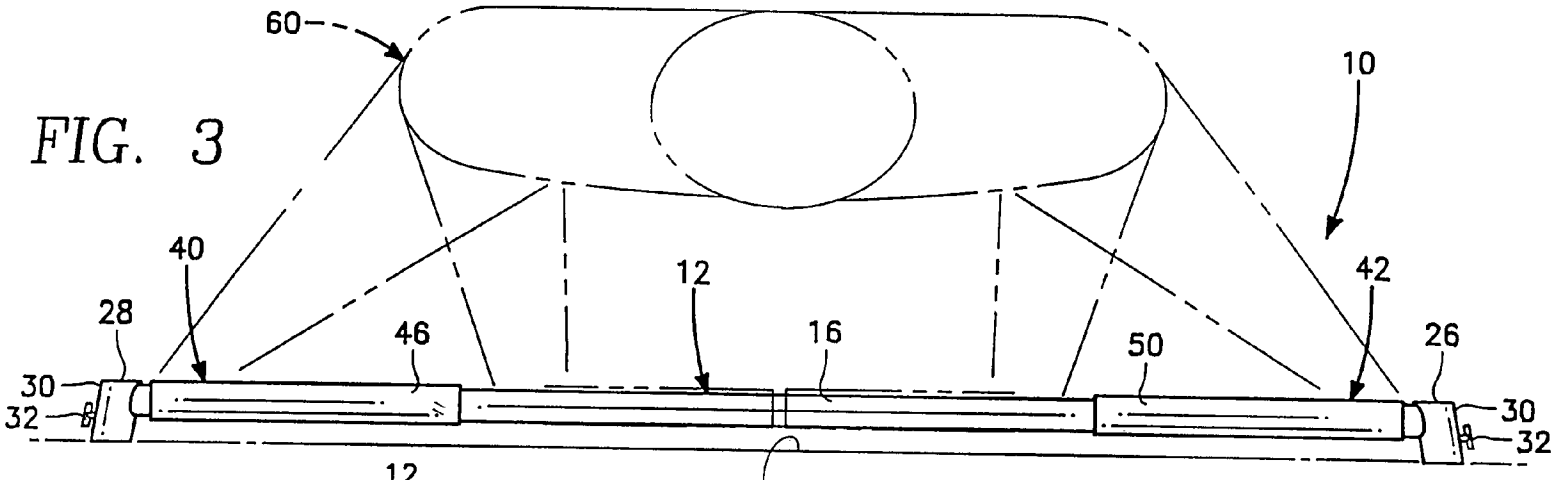
FIG. 3 is a side elevational view of the main-frame portion of the exercise stand of the present invention showing the exercise stand being used in conjunction with a traditional push-up by a human user.
Figure 4:
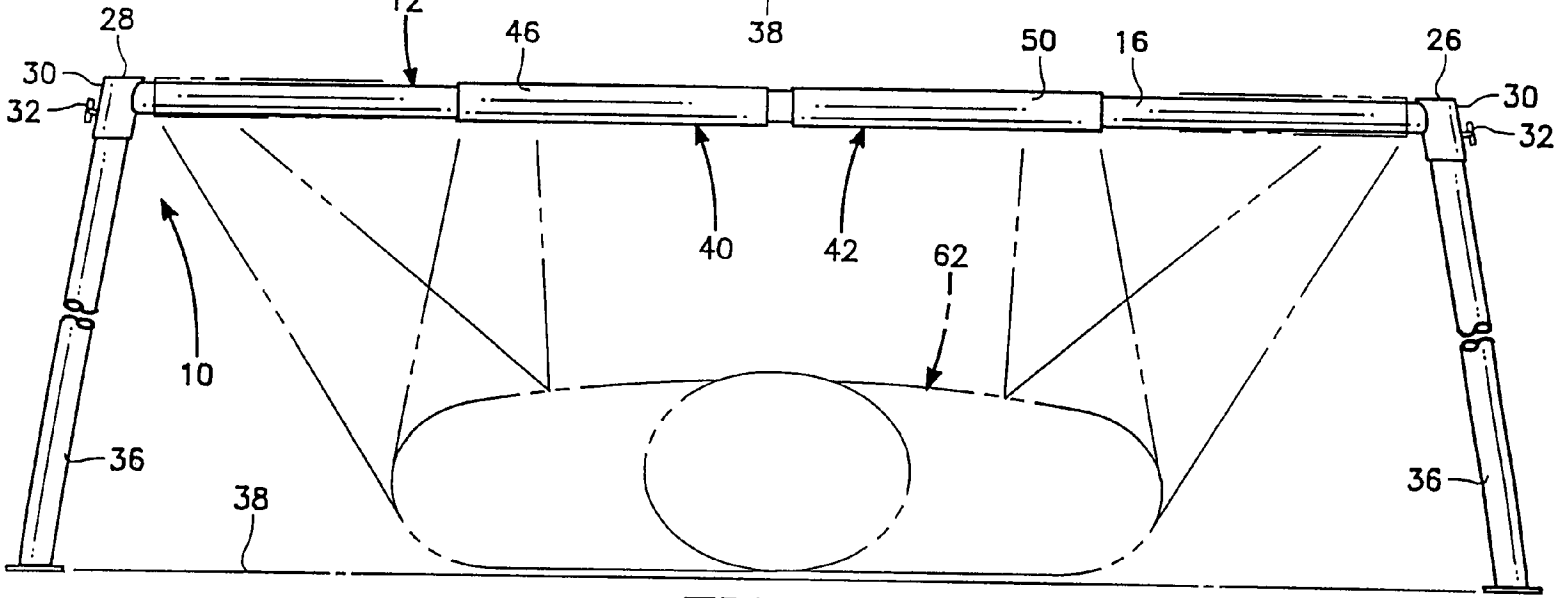
FIG. 4 is a side elevational view of the exercise stand of the present invention depicting usage by a human user in performing reverse push-ups.

Referring particularly to FIG. 1, there is shown the exercise stand 10 of this invention. The exercise stand 10 is constructed of a main frame 12 which is composed of a pair of parallel spaced apart members defined as main tubes 14 and 16 which are interconnected at their respective ends by a pair of cross members defined as cross tubes 18 and 20. Although tubes are shown, any desirable configuration for the members could be used, such as flat bars, solid rods or horizontal or octagonally shaped tubes or rods. The tubes 14 and 16 will generally be of the same length with a typical length being in the range of three to four feet. The cross tubes 18 and 20 are also of the same length with generally a typical length being in the range of fourteen to eighteen inches. Typical materials of construction for the tubes 14–20 could be of plastic, carbon, fiber or metals. The tubes 14–20 are arranged in a rectangular pattern defining corners 22, 24, 26 and 28. At each of the corners 22–28, there is mounted a leg connector 30. Associated with each leg connector 30 is a wing nut set screw 32. Instead of the wing nut set screw 32, there could be used a pin or other fastener. A short leg 34 could be mounted in conjunction with each leg connector 30 and secured in place by the set screw 32. Also, a long leg 36 could be substituted for the short leg 34 again fixedly secured in place by the set screw 32. It is to be understood that any desired length of leg 34 or 36 could be utilized or in fact no leg could be utilized, as is shown in FIG. 3. In FIG. 3, the connectors 30 rest directly on the supporting surface 38 functioning as short legs. In FIG. 4, the legs 36 rest on the supporting surface 38.

Typically, the exterior diameter of the connectors 30 are approximately one and one-quarter of an inch in diameter. The diameter of the main frames 12 and 14 and the cross tubes 18 and 20 will generally be about one inch. As can be readily observed in FIG. 4, the legs 36 are not located parallel but flare slightly outwardly. This flaring of the legs 36 in an outward direction is so as to give increased overall support to the exercise stand and make it less likely for the exercise stand to tip over.

Mounted between the main tubes 14 and 16 are a pair of sub-frames 40 and 42. The sub-frame 40 has a main support member 44 which is telescopingly slidingly mounted on the main tube 14. The sub-frame 40 also has a main support member 46 which is telescopingly slidingly mounted on the main tube 16. In a similar manner, the sub-frame 42 has a main support member 48 which is telescopingly slidingly mounted on the main tube 14. The sub-frame 42 also as a main support member 50 which is slidingly mounted on the main tube 16. The main support members 44–50 are all of the same diameter and generally a one and one-quarter of an inch exterior diameter has been found to be satisfactory. Interconnecting the main support members 44 and 46 is a cross member 52 which is connected in a vertically oriented relationship to both of the main support members 44 and 46. The sub-frame 42 has a similar cross member 54 which is connected in a vertically connecting relationship between the main support members 48 and 50. The sub-frame 40 also has an inclined cross member 56 which connects between the junction of the cross member 52 with the main support member 46 to the main support member 44 at its innermost end. The result is the inclined cross member 56 in conjunction with the cross member 52 and the main support member 44 forms a right triangle. Typically, the diameter of the cross members 52 and 56 will be three-quarters of an inch. The sub-frame 42 also includes an inclined cross member 58 which is also similarly connected to the main cross member 50 at the junction with the cross member 54 and to the inner end of the main support member 48. Again, the inclined cross member 58, cross member 54 and main support member 48 form a right triangle configuration.

Each of the sub-frames 40 and 42 can be lineally slid in the direction of arrows 64 and 66 from a pair of the corners 30 to a position where such essentially abut one another in the area of the mid-point of the length of the main frame 12. A set screw or other mechanism could be used to lock each of the sub frames in place at a desired location. When using of the exercise stand to perform push-ups, where there is a user 60 as shown in FIG. 3 in an over area, by where the sub-frames 40 and 42 are placed, different working of the pectoral muscles is achieved. With the sub-frames 40 and 42 further apart, a wider definition of the pectoral muscles is achieved and with the sub-frames 40 and 42 placed closer together, a more pronounced appearance of the pectoral muscles will be obtained. When a user uses the exercise stand 10 of this invention to perform push-ups, the user also works the triceps and the anterior deltoids.

To perform pull-ups or "reverse push-ups", a user 62 is positioned, as shown in FIG. 4. This places the user in an underneath area under the main frame 14. The user is oriented in FIG. 4 face up, and the user then grabs either members 52 and 54 or members 56 and 58. The user is to first adjust the position of the sub-frames 40 and 42 on the main frame 12 and again depending upon whether a narrow position is selected or outer position is selected, a variance in the definition of the appropriate muscles that are being worked will be obtained. In normal operation, a user will position the sub-frames 40 and 42 at various positions on the main frame 12 and perform a series of pull-ups or push-ups at each selected position.

Using the exercise stand 10 of this invention, it has been found that the user is able to strengthen and tone the muscles of the upper body in perfect symmetric balance. The muscles that are toned are in the chest and the back. Various degrees of difficulty can be available when performing of exercises by the user. For example, in FIG. 3 when doing push-ups, the user could be on his or her knees which makes the push-up a lot easier than if the user was on his or her toes. Also, if the user places his or her toes on an elevated surface, such as the surface of a chair, a more difficult and strenuous exercise can be obtained. Also, when doing pull-ups in FIG. 4, if the user maintains his or her body completely rigid, a more strenuous exercise is achieved than if the user bends his or her knees.

The exercise stand 10 of the present invention is simple to use, can be set up in seconds, is adjustable in height and width to any size body for maximum comfort and desired difficulty of level by using the sub-frames 40 and 42. The exercise stand 10 of this invention is safe and completely eliminates the discomfort and injury associated with conventional push-ups or back exercises. Also, another advantage of the present invention is that the exercise stand 10 is inexpensive with the exercise stand 10 being able to be manufactured at low cost and sold at prices that are attractive to the consumer yet profitable for the manufacturer.

What is claimed is:

1. An exercise stand comprising:

a main frame defined by a longitudinal pair of main tubes and a pair of transversely oriented cross tubes, said main tubes located parallel and spaced apart, said cross tubes located parallel and spaced apart, one of said cross tubes located at an end of said main tubes with another of said cross tubes located at an opposite end of said main tubes, said cross tubes being fixed to said main tubes, said main frame being rectangular in shape forming four in number of corners, a leg connector mounted at each of said corners, a leg mounted at each said corner connecting with a said leg connector and extending outward from said main frame, each said leg being removably securable to its respective said leg connector, said main frame when resting by said legs on a supporting surface define an underneath area located between said main frame and the supporting surface and an over area located above said main frame, a human exerciser can utilize both said underneath area and said over area; and a pair of sub-frames telescopingly mounted on said main frame, each of said sub-frames being lineally slidably movable on said main frame to vary spacing between said sub-frames, each of said sub-frames including a pair of main support members each of which are interconnected by a cross member and an inclined cross member, whereby a human user can perform a plurality of different exercises by grabbing said cross tubes or said main support members or said cross member or said inclined cross member and slide said sub-frames on said main frame.

2. The exercise stand as defined in claim 1 wherein:

said main support members being located parallel to each other.

3. The exercise stand as defined in claim 1 wherein:

the connection of said cross member and said inclined cross member with said main support member is in the shape of a right triangle.

* * * * *